US012264434B2

(12) United States Patent
Uemura et al.

(10) Patent No.: US 12,264,434 B2
(45) Date of Patent: Apr. 1, 2025

(54) SYNTHETIC RESIN LEATHER

(71) Applicants: HONDA MOTOR CO., LTD., Tokyo (JP); OKAMOTO INDUSTRIES, INC., Tokyo (JP)

(72) Inventors: Tomoyuki Uemura, Saitama (JP); Shin Nakaya, Shizuoka (JP); Yoshinari Hatori, Shizuoka (JP); Takaji Suzuki, Shizuoka (JP)

(73) Assignee: OKAMOTO INDUSTRIES, INC., Tokyo (JP)

( * ) Notice: Subject to any disclaimer, the term of this patent is extended or adjusted under 35 U.S.C. 154(b) by 742 days.

(21) Appl. No.: 16/890,810

(22) Filed: Jun. 2, 2020

(65) Prior Publication Data

US 2020/0385921 A1 Dec. 10, 2020

(30) Foreign Application Priority Data

Jun. 4, 2019 (JP) ..... 2019-104869

(51) Int. Cl.
*D06N 3/14* (2006.01)
*D06N 3/00* (2006.01)

(52) U.S. Cl.
CPC ..... *D06N 3/14* (2013.01); *D06N 3/0009* (2013.01); *D06N 3/0077* (2013.01); *D06N 2211/263* (2013.01); *D06N 2211/266* (2013.01); *D06N 2211/267* (2013.01); *D06N 2211/28* (2013.01)

(58) Field of Classification Search
CPC . D06N 3/14; D06N 3/00; B32B 27/40; B32B 27/12
See application file for complete search history.

(56) References Cited

U.S. PATENT DOCUMENTS

| | | | |
|---|---|---|---|
| 2010/0075559 A1 | 3/2010 | Hatori et al. | |
| 2010/0093243 A1† | 4/2010 | Uemura | |
| 2020/0157736 A1† | 5/2020 | Shinozaki | |

FOREIGN PATENT DOCUMENTS

| | | | |
|---|---|---|---|
| CN | 103410009 A | 11/2013 | |
| CN | 103556489 A | 2/2014 | |
| CN | 105377626 A | 3/2016 | |
| EP | 3647483 * | 6/2018 | ..... B32B 27/12 |
| JP | H09111671 A | 4/1997 | |

(Continued)

OTHER PUBLICATIONS

JPO; Application No. 2019-104869; Notice of Refusal dated Jan. 4, 2022.

(Continued)

*Primary Examiner* — Lynda Salvatore
(74) *Attorney, Agent, or Firm* — MILLEN, WHITE, ZELANO & BRANIGAN, P.C.; Ryan R. Pool

(57) ABSTRACT

There is provided a synthetic resin leather having excellent durability against wrinkling and favorable texture without impairing flexibility of a synthetic resin layer when seated. A synthetic resin leather which is used as a skin material for a seat or chair, including: a base cloth layer formed of a knit fabric; and a synthetic resin layer which has flexibility and is joined to one surface of the base cloth layer, wherein the knit fabric is made of filament yarn having a thickness of 111 to 444 dtex and a surface side of the knit fabric is adhered to a back surface side of the synthetic resin layer.

8 Claims, 2 Drawing Sheets

(56) References Cited

FOREIGN PATENT DOCUMENTS

| | | | |
|---|---|---|---|
| JP | 2005-23448 | A1 † | 1/2005 |
| JP | 2005023448 | A | 1/2005 |
| JP | 2006-188773 | A | 7/2006 |
| JP | 2010-111989 | A | 5/2010 |
| JP | 2013-011034 | A | 1/2013 |
| JP | WO2015/001732 | A1 † | 1/2015 |
| JP | WO2019/004180 | A1 † | 1/2019 |
| WO | WO2006/067848 | A1 | 6/2006 |

OTHER PUBLICATIONS

CNIPA; Application No. 202010488389.4; Notice of First Review dated Jul. 19, 2022.

JPO; Application No. 2019-104869; Notification of Reasons for Refusal dated May 25, 2021.

CNIPA; Application No. 202010488389.4; Notice of Second Office Action dated Feb. 20, 2023.

Appeal Decision in corresponding Japanese patent application No. 2019-104869 (dispatched on Nov. 14, 2023) (2 pages) and English translation thereof (1 page).

English translation of Decision of Refusal for corresponding Chinese patent application No. 202010488389.4 issued on Jan. 20, 2024 (pp. 1-4).

Office action for corresponding Chinese patent application No. 202010488389.4 issued Sep. 12, 2023 (pp. 1-4) and english translation thereof (pp. 1-6).

Office action for corresponding Japanese patent application No. 2019-104869 dispatched Sep. 19, 2023 (pp. 1-2) and english translation thereof (pp. 1-2).

* cited by examiner
† cited by third party

SYNTHETIC RESIN LEATHER

CROSS-REFERENCE TO RELATED APPLICATION

The present application claims the benefit of priority of Japanese Patent Application No. 2019-104869 filed on Jun. 4, 2019, the contents of which are incorporated herein by reference in their entirety.

1. FIELD OF THE INVENTION

The present invention relates to a synthetic resin leather used as a skin material for the seats of vehicles such as automobiles, aircraft, and ships, and other chairs.

2. DESCRIPTION OF THE RELATED ART

In the related art, regarding this type of synthetic resin leather, there is a synthetic leather in which a urethane adhesion layer and a polyurethane skin layer are sequentially laminated on the surface of a base cloth and in which the base cloth is a knitted fabric with a raised surface, and 20% to 99% of the length of the raised fiber is present in the adhesion layer (for example, see Japanese Patent Application Publication No. H09-111671).

The knitted fabric constituting the base cloth is a knitted fabric in which spun yarn passes in the course direction of the knitted fabric as weft yarn, and is subjected to special knitting and the elongation percentage of the base cloth in the vertical and horizontal is 60% to 100%.

This specially knitted fabric can be obtained by, for example, a method in which a double-sided knitting knitted fabric is used as a base, and spun yarn is subjected to cross-miss interlock in the course direction at appropriate intervals and knitted.

CITATION LIST

Patent Literature

[PTL 1] Japanese Patent Application Publication No. H09-111671

SUMMARY OF THE INVENTION

In recent years, the shape and hardness of seats have been changed in order to change the manufacturing operation of vehicle seats or in order to improve ride comfort. Along with this change, it is required that a skin material used in seats have toughness with respect to not wrinkling.

However, spun yarn is conventionally used in a knitted fabric serving as a base cloth, and since the spun yarn is a short fiber, even if a plurality of short fibers is bundled to form long yarn, short fibers that form a fiber structure are likely to be misaligned with each other and a feeling of tension in a base cloth (fabric) be insufficient.

Therefore, when used as a skin material for seats of automobiles and other chairs, if wrinkles are generated on the surface of a polyurethane skin layer in accordance with use, the wrinkles continue to remain and the surface does not recover, which results in a problem of poor crease resistance.

Under such circumstances, there is a demand for a synthetic leather (synthetic resin leather) having excellent durability against wrinkling when used as a skin material for seats.

In order to achieve such a demand, according to one aspect of the present invention, there is provided a synthetic resin leather used as a skin material for a seat or chair, including a base cloth layer formed of a knit fabric and a synthetic resin layer which has flexibility and is joined to one surface of the base cloth layer, wherein the knit fabric is made of filament yarn having a thickness of 111 to 444 dtex and a surface side of the knit fabric is adhered to a back surface side of the synthetic resin layer.

BRIEF DESCRIPTION OF THE DRAWINGS

FIG. 1A is a longitudinal front view of its partially enlarged main parts, and FIG. 1B is a conceptual view showing an example of a knit fabric knitting method.

DESCRIPTION OF THE PREFERRED EMBODIMENTS

Embodiments of the present invention will be described below in detail with reference to the drawings.

Figure 1A:
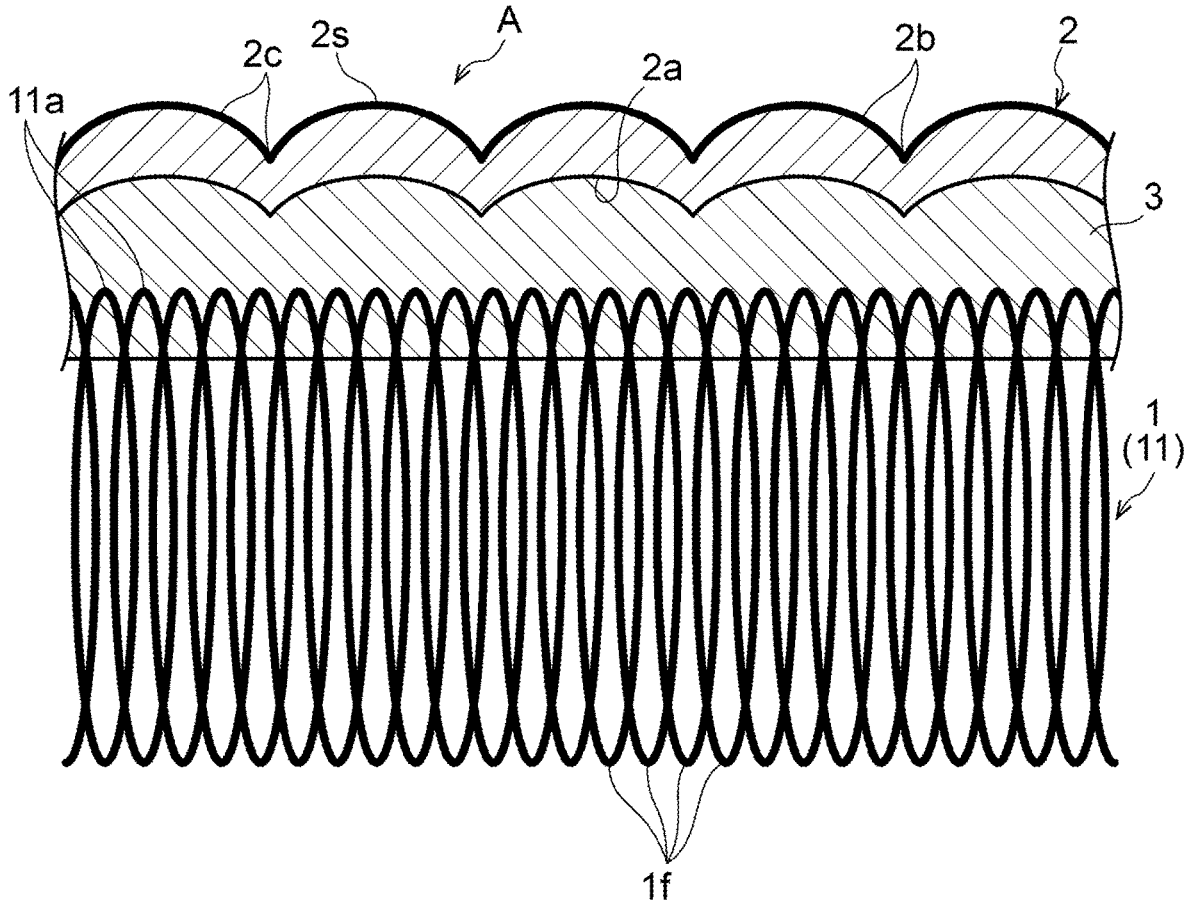
FIG. 1A and FIG. 1B show explanatory diagrams of an overall structure of a synthetic resin leather according to an embodiment of the present invention.
Figure 1B:
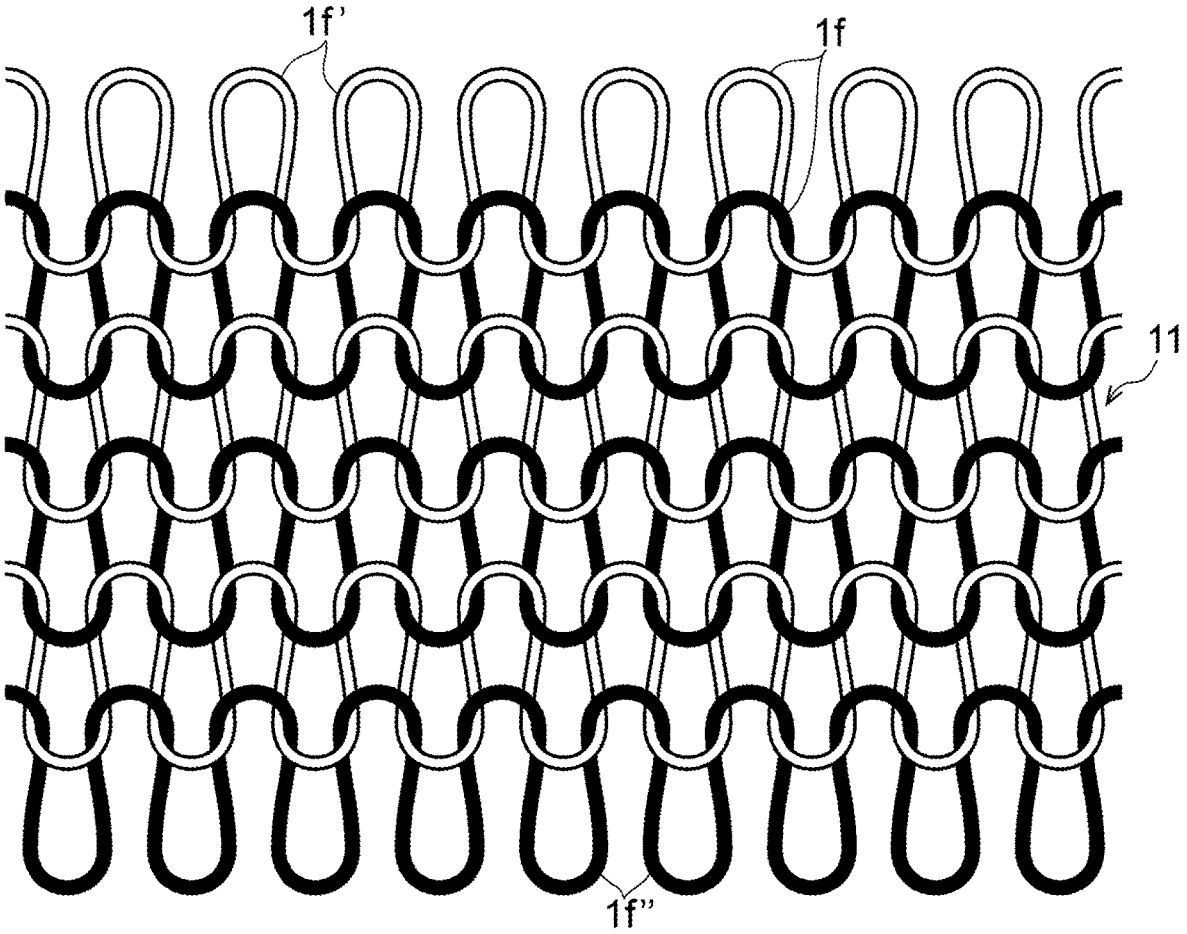

A synthetic resin leather A according to an embodiment of the present invention is a synthetic leather used as a skin material for seats of vehicles such as automobiles, aircraft, and ships, and other chairs, and as shown in FIGS. 1A and 1B, a synthetic resin layer 2 is attached to one surface of a base cloth layer 1.

More specifically, the synthetic resin leather A according to the embodiment of the present invention includes the base cloth layer 1 formed of a knit fabric 11 and the synthetic resin layer 2 which has flexibility and is joined to one surface of the base cloth layer 1 as main components.

In addition, it is preferable to provide an adhesion layer 3 laminated between the base cloth layer 1 and the synthetic resin layer 2.

Base Cloth Layer

As shown in FIGS. 1A and 1B, the base cloth layer 1 is formed of the knit fabric 11 in which only filament yarn if is knitted, and a surface side 11*a* of the knit fabric 11 is adhered to the side of a back surface 2*a* of the synthetic resin layer 2.

The filament yarn if is a continuous long fiber longer than spun yarn (short fiber), and particularly, yarn which is thicker than the spun yarn and has excellent strength and elasticity is used. Regarding the filament yarn 1*f*, a monofilament in which single yarn (single fiber) may be used, and a multifilament in which a plurality of single yarns (single fibers) is twisted, mixed spun yarn in which a plurality of raw materials is mixed and spun in the stage of fibers, or the like may be used.

Regarding the material of the filament yarn 1*f*, polyethylene terephthalate (PET), a cellulosic fiber such as (viscose) rayon, urethane, and acrylic may be used alone, or mixed yarn of such a cellulosic fiber, and PET, urethane, or acrylic may be used.

The thickness (fineness) of the filament yarn if is preferably set to 111 to 444 dtex (or T), specifically 150 to 400 dtex, and more specifically 160 to 350 dtex.

The knit fabric 11 is a knitting component in which a three-dimensional knitted fabric is formed by mixing and knitting yarn of different materials or knitting yarn of the same material as the filament yarn 1*f*, and continuously forming loops.

Examples of knitting methods of the filament yarn if include plain knitting (jersey knitting), double-sided knitting (smooth knitting), horizontal (weft) knitting such as rib knitting, and vertical (warp) knitting.

Preferably, in the knit fabric 11, the knitting density is set to 30/25 or more (W(wale)/C(course)), the elongation is set to 80/80 or more (warp direction/weft direction), and the thickness is set to 0.7 to 1.5 mm.

As a specific example of a knitting method, in the case shown in FIG. 1B, first yarn 1*f'* and second yarn 1*f''* whose materials are different from each other are plain-knitted as the filament yarn 1*f*.

In addition, although not shown, as another example, the knitting method of the filament yarn if can be changed to a method other than plain knitting.

In addition, the knit fabric 11 of the base cloth layer 1 is preferably subjected to heat setting so that the form and dimensional stability are maintained according to heat treatment. In the heat setting, the heating temperature is preferably set to 140° C. to 200° C., and specifically 170° C. to 190° C.

Synthetic Resin Layer

For example, the synthetic resin layer 2 is formed as a layer mainly composed of thermoplastic polyurethane or similar thermoplastic resin. The thermoplastic polyurethane can be obtained by reacting a diisocyanate compound with a compound having two or more hydroxyl groups. In particular, among thermoplastic polyurethanes, a polyurethane thermoplastic elastomer (TPU) composed of a so-called soft segment and hard segment, including a long chain polyol, a diisocyanate, and a chain extender, is preferably used. Regarding the hardness, a thermoplastic polyurethane having a Shore A hardness of 70 to 95 hardness in a resin, and specifically, 80 to 90 hardness in a resin is preferable. Here, the Shore A hardness is a value measured by ASTM D 2240 (measurement temperature of 23° C.).

When a material constituting the synthetic resin layer 2 is a mixed resin component, 50% or more of a thermoplastic polyurethane component is contained, or when a plurality of types of resin components are contained, a component having the highest proportion among these is preferably a thermoplastic polyurethane.

Basically, the synthetic resin layer 2 is preferably made of a mixed resin containing a thermoplastic polyurethane and other resin components and having high softness and bendability and favorable workability and strength.

As shown in FIG. 1A, a surface 2*b* of the synthetic resin layer 2 may have a surface treated layer 2*s*.

The surface treated layer 2*s* can be formed by applying an oil-based surface treatment agent in which a silicone-copolymerized polycarbonate polyurethane is crosslinked with an isocyanate crosslinking agent. The surface treated layer 2*s* is formed by applying an organic solvent-based surface treatment agent, and is formed on the surface 2*b* of the synthetic resin layer 2 into which an organic solvent penetrates with high adhesion.

On the surface 2*b* and the surface treated layer 2*s* of the synthetic resin layer 2, as necessary, an uneven pattern 2*c* such as an embossed pattern (wrinkle pattern) can be formed.

In addition, regarding the diisocyanate compound which is a main component of the synthetic resin layer 2 and is used to synthesize thermoplastic polyurethane, tolylene diisocyanate, diphenylmethane diisocyanate, naphthalene diisocyanate, triazine diisocyanate, hexamethylene diisocyanate, xylylene diisocyanate, hydrogenated xylylene diisocyanate, hydrogenated dicyclohexylmethane diisocyanate, isophorone diisoyanate, or the like is used.

In addition, regarding the compound having two or more hydroxyl groups, a polyester polyol which is a condensation reaction product of a dibasic acid such as adipic acid and phthalic acid, and a glycol such as ethylene glycol and 1,4-butanediol; a polycarbonate polyol which is a reaction product of a carbonate such as ethylene carbonate and a glycol; a polyether polyol such as polyethylene glycol, polypropylene glycol, polytetramethylene glycol, and polyethylene glycol-polypropylene glycol, or the like is used.

In the synthetic resin leather A according to the embodiment of the present invention, it is preferable to use a polyether polyol in consideration of its physical properties. Here, a thermoplastic polyurethane containing a polyether polyol as a raw material is preferable because it has favorable aging resistance and calender workability.

Regarding the chain extender, a low-molecular-weight polyhydric alcohol such as ethylene glycol, 1,2-propylene glycol, 1,3-propylene glycol, butane-1,2-diol, butane-1,3-diol, butane-1,4-diol, butane-2,3-diol, and hexanediol, or diamine, or water is used.

As described above, when the synthetic resin layer 2 is formed of a mixed resin containing a thermoplastic polyurethane and other resin components, an acrylic soft resin can be selected as one component to be mixed in. The acrylic soft resin is a resin that exhibits softness at room temperature such as soft polyvinyl chloride. For the acrylic soft resin, those having a Shore A hardness of 50 to 80 and particularly 55 to 65 are preferably used. The acrylic soft resin is preferably a multi-layer structure polymer, that is, a particulate polymer in which two or more acrylic polymers form a core-shell type multi-layer structure. This acrylic soft resin exhibits favorable softness at room temperature and has bending resistance, and excellent weather resistance.

An example of the acrylic soft resin used as a component of the synthetic resin layer 2 will be described. An acrylic soft multi-layer structure resin is a multi-layer structure polymer which is obtained by combining 10 to 90 parts by weight of at least one polymer layer [A] which is obtained by polymerizing a monomer mixture containing 30 to 99.9 percent by weight of at least one acrylic acid alkyl ester having an alkyl group having 1 to 12 carbon atoms, 0 to 70 percent by weight of at least one methacrylic acid alkyl ester having an alkyl group having 1 to 8 carbon atoms, 0 to 30 percent by weight of a copolymerizable unsaturated monomer, and 0.1 to 10 percent by weight of a multifunctional crosslinkable monomer and/or a multifunctional graft monomer and which has a Tg of 30° C. or lower, and 10 to 90 parts by weight of at least one polymer layer [B] obtained by polymerizing a monomer mixture containing 30 to 99 percent by weight of at least one acrylic acid alkyl ester having an alkyl group having 1 to 12 carbon atoms, 1 to 70 percent by weight of at least one methacrylic acid alkyl ester having an alkyl group having 1 to 8 carbon atoms, and 0 to 30 percent by weight of a copolymerizable unsaturated monomer and which has a Tg of −20 to 50° C., and the polymer layer [B] is the outermost layer.

Another example of the acrylic soft resin will be described. An acrylic soft multi-layer structure resin contains 30 to 80 parts by weight of a rubber layer obtained by polymerizing 60 to 99.5 percent by weight of an acrylic acid alkyl ester having an alkyl group having 1 to 8 carbon atoms, 0 to 39.5 percent by weight of a monofunctional monomer having one copolymerizable vinyl group and 0.5 to 5 percent by weight of a multifunctional monomer having at least two vinyl groups or vinylidene groups, and 20 to 70 parts by weight of a rigid resin layer obtained by polymerizing 40 to 100 percent by weight of methyl methacrylate, 0 to 60 percent by weight of an acrylic acid alkyl ester having an alkyl group having 1 to 8 carbon atoms and 0 to 20 percent by weight of monomers having a copolymerizable vinyl group or vinylidene group, and the rigid resin layer is the outermost layer.

Still another example of the acrylic soft resin will be described. An acrylic soft multi-layer structure resin having an average particle size of 0.01 to 0.3 μm contains (A) 5 to 30 parts by weight of a rigid polymer layer as an innermost layer obtained by polymerizing a monomer mixture containing 80 to 98.99 percent by weight of methyl methacrylate, 1 to 20 percent by weight of an acrylic acid alkyl ester having an alkyl group having 1 to 8 carbon atoms, 0.01 to 1 percent by weight of a multifunctional graft agent and 0 to 0.5 percent by weight of a multifunctional cross-linking agent; (B) 20 to 45 parts by weight of a rigid polymer layer as an intermediate layer obtained by polymerizing a monomer mixture containing 70 to 99.5 percent by weight of an acrylic acid alkyl ester having an alkyl group having 1 to 8 carbon atoms, 0 to 30 percent by weight of methyl methacrylate, and 0.5 to 5 percent by weight of a multifunctional graft agent and 0 to 5 percent by weight of a multifunctional cross-linking agent; and (C) 50 to 75 parts by weight of a rigid polymer layer as an outermost layer obtained by polymerizing a monomer mixture containing 90 to 99 percent by weight of methyl methacrylate, and 1 to 10 percent by weight of an acrylic acid alkyl ester having an alkyl group having 1 to 8 carbon atoms.

When the synthetic resin layer 2 is formed, the mixing ratio of the thermoplastic polyurethane and the acrylic soft resin is a ratio of 70 to 95 percent by weight of the thermoplastic polyurethane and 5 to 30 percent by weight of the acrylic soft resin, and preferably a ratio of 80 to 90 percent by weight of the thermoplastic polyurethane and 10 to 20 percent by weight of the acrylic soft resin.

When a plasticizer is mixed into the synthetic resin layer 2, it is possible to improve softness and texture of a product. In addition, when the plasticizer is mixed in, it is possible to lower a processing temperature in calender processing of the mixed resin, and therefore, it is possible to minimize decomposition of the thermoplastic polyurethane during processing. Regarding the plasticizer, phthalates such as di-2-ethylhexyl phthalate, isobutyl phthalate, and diisodecyl phthalate; trimellitates such as tri-2-ethylhexyl trimellitate; aliphatic dibasic acid esters such as di(2-ethylhexyl) adipate, di-isononyl adipate, and di(2-ethylhexyl) sebacate; epoxy plasticizers such as epoxidized soybean oil, and butylepoxy stearate, phosphate esters such as tricresyl phosphate, citrates such as acetyl tributyl citrate, and the like are used. Among these, particularly, aromatic carboxylates such as phthalates and trimellitates are preferably used because they have high plasticization efficiency and fewer problems such as bleeding. The amount of the plasticizer mixed in is 0 to 50 parts by weight and preferably 3 to 20 parts by weight with respect to 100 parts by weight of the mixed resin.

The synthetic resin layer 2 may further contain a lubricant, a UV absorber, a light stabilizer, a pigment, an antimicrobial, and the like which are generally used for formulating a synthetic resin, as necessary. Regarding the lubricant, aliphatic metal salts such as calcium, magnesium, zinc, and barium stearates, polyethylene wax, stearic acid, alkylene bis fatty acid amides and the like are used. Regarding the UV absorber, a benzotriazole UV absorber such as 2-(2'-hydroxy-5'-methylphenyl)benzotriazole is used. Regarding the light stabilizer, a hindered amine light stabilizer such as bis-(2,2,6,6-tetramethyl-4-piperidyl) sebacate is used. Regarding the antimicrobial, a silver-based inorganic antimicrobial and the like are used.

Adhesion Layer

The knit fabric 11 of the base cloth layer 1 and the synthetic resin layer 2 are attached with the adhesion layer 3 therebetween.

Regarding an adhesive that forms the adhesion layer 3, a urethane adhesive such as polycarbonate urethane (PCU) and a two-liquid polyurethane, an ethylene-vinyl acetate copolymer emulsion, a polyvinyl chloride paste and the like are used. The adhesive may be applied to the surface side 11*a* of the base cloth layer 1 or may be applied to the side of the back surface 2*a* of the synthetic resin layer 2. Among these, an aqueous polycarbonate urethane is preferably used.

The permanent distortion of the synthetic resin leather A composed of the base cloth layer 1 and the synthetic resin layer 2 integrated with the adhesion layer 3 therebetween is preferably set to 0.5 to 3.0%.

Thickness of Synthetic Resin Layer

In the synthetic resin layer 2, when a proportion of the main component TPU mixed in increases and the thickness of the synthetic resin layer 2 becomes relatively increasingly thicker than the thickness of the base cloth layer 1 (the knit fabric 11), the permanent distortion of the synthetic resin leather A tends to decrease, which was determined by an experiment.

More specifically, when the knit fabric 11 has a constant thickness and the proportion of TPU mixed into the synthetic resin layer 2 is 85%, and the thickness is 0.35 mm, the permanent distortion (hysteresis loss) at 50% elongation is reduced by about 60% compared to when the proportion of TPU mixed in is 75% and the thickness is 0.25 mm.

The same tendency was confirmed in a "crease resistance" test described below assuming actual use as a skin material for seats of automobiles and the like. As one index of "crease resistance," hysteresis loss measurement can be referred to in order to evaluate the residual strain (image of seating endurance) with respect to repeated elongation. The residual strain during repeated 50% elongation measurement was used for comparison in terms of the amount of distortion per unit energy (residual strain/applied energy).

Based on such experiment results, when the thickness of the synthetic resin layer 2 is set to 0.25 times the thickness of the knit fabric 11 or more, it is calculated that the permanent distortion can be reduced to being within an allowable range.

As an example, when the thickness of the knit fabric 11 is 0.7 to 1.5 mm, and the proportion of TPU mixed into the synthetic resin layer 2 is 85%, the synthetic resin layer 2 is preferably set to 0.20 to 0.40 mm or more.

Production Method

Next, a method of producing a synthetic resin leather A according to an embodiment of the present invention will be described. The method includes a film molding step in which the synthetic resin layer 2 containing a thermoplastic polyurethane as a main component is molded and a base cloth adhering step in which the base cloth layer 1 is adhered to the side of the back surface 2*a* of the synthetic resin layer 2 with the adhesion layer 3 therebetween.

In the film molding step, for example, the synthetic resin layer 2 containing a thermoplastic polyurethane as a main component is molded by calender molding, extrusion molding, or the like.

In the base cloth adhering step, the adhesive is applied to one or both of the side of the back surface 2*a* of the synthetic resin layer 2 and the surface side 11*a* of the knit fabric 11 of the base cloth layer 1, and the synthetic resin layer 2 and the knit fabric 11 of the base cloth layer 1 are adhered with the adhesion layer 3 therebetween.

According to the synthetic resin leather A according to the embodiment of the present invention, in the knit fabric 11 which will become the base cloth layer 1, all of the knitting yarn is made into filament yarn (long fiber) if with a thickness of 111 to 444 dtex. Therefore, when the density of the knit fabric 11 increases, the tension increases at the same time.

Therefore, in a state in which the surface side 11*a* of the knit fabric 11 is adhered and attached to the side of the back surface 2*a* of the synthetic resin layer 2 having flexibility, while taking advantage of the flexibility of the synthetic resin layer 2, folded and buckling crease hardly adhere to the surface 2*b* of the synthetic resin layer 2, and at the same time, the recoverability such as folded and buckling crease is also excellent.

Therefore, it is possible to provide the synthetic resin leather A having excellent durability against wrinkling and favorable texture without impairing flexibility of the synthetic resin layer 2 when seated.

As a result, compared to conventional fabrics in which spun yarn is used in the knitted fabric as a base cloth, seating comfort is improved and it is beneficial when used as a skin material for seats of automobiles and other chairs, it being possible to maintain a high commercial value for a long period of time and the convenience is excellent.

In particular, the knit fabric 11 of the base cloth layer 1 is preferably subjected to heat setting.

In this case, when heat setting is performed, a feeling of tension of the knit fabric 11 is strong and a shape retaining function is provided.

Therefore, it is possible to further improve durability against wrinkling.

As a result, when used as a skin material for seats of automobiles and other chairs, it is possible to maintain a high commercial value for a longer period of time.

In addition, preferably, the synthetic resin layer 2 contains a polyurethane thermoplastic elastomer (TPU) as a main component, and the thickness of the synthetic resin layer 2 is set to 0.25 times the thickness of the knit fabric 11 or more.

In this case, when the thickness of the synthetic resin layer 2 containing TPU as a main component is thicker than the thickness of the knit fabric 11, the permanent distortion is reduced, wrinkles hardly occur, and at the same time, the wrinkle recoverability is also excellent.

Therefore, it is possible to further improve the durability against wrinkling without impairing flexibility of the synthetic resin layer 2.

As a result, when used as a skin material for seats of automobiles and other chairs, it is possible to maintain a high commercial value for a longer period of time.

EXAMPLES

Examples of the present invention will be described below.

Examples 1 to 4 and Comparative Examples 1 to 4

Examples 1 to 4 shown in Table 1 and Comparative Examples 1 to 4 shown in Table 2 were obtained by preparing a base cloth layer (knit fabric) and a synthetic resin layer described therein, and attaching the base cloth layer and the synthetic resin layer with an adhesion layer therebetween. Then, evaluation samples with the same size were produced.

In Examples 1 to 4 and Comparative Examples 1 to 4, a knit fabric knitting method was double-sided knitting (reversible knitting), the thickness thereof was 1.1 mm, and the configurations were the same. Here, the knitting density was 36/29 (W/C) and the elongation was set to 85/180 (warp direction/weft direction). In the knit fabrics of Examples 1 to 4 and Comparative Examples 1 and 2, heat setting was performed and the configurations were the same.

The synthetic resin layers of Examples 1 to 4 and Comparative Examples 1 to 4 were formed of a mixed resin containing 85 percent by weight of a polyurethane thermoplastic elastomer (TPU) and 15 percent by weight of an acrylic soft resin, the thickness was 0.35 mm, the hardness thereof was 85A, and the configurations were the same.

The adhesion layers 3 of Examples 1 to 4 and Comparative Examples 1 to 4 were formed of polycarbonateurethane (PCU), the thickness thereof was 0.03 mm, and the configurations were the same.

In Example 1, for one of knit fabric filament yarn, filament yarn made of polyethylene terephthalate (PET) and having a thickness (fineness) of 333 dtex was used as first yarn, and for the other thereof, filament yarn made of rayon and having a thickness of 167 dtex was used as second yarn. The filament yarn with a thickness of 333 dtex was made of two of filament yarn with a thickness of 167 dtex.

In Example 2, filament yarn made of PET and having a thickness of 167 dtex was used as first yarn, and filament yarn made of rayon and having a thickness of 167 dtex was used as second yarn.

In Example 3, filament yarn made of PET and having a thickness of 444 dtex was used as first yarn and second yarn.

In Example 4, filament yarn made of PET and having a thickness of 111 dtex was used as first yarn and second yarn.

On the other hand, Comparative Example 1 was different in that filament yarn made of PET and having a thickness of 500 dtex was used as first yarn and second yarn. The filament yarn with a thickness of 500 dtex was made of three of filament yarn with a thickness of 167 dtex.

Comparative Example 2 was different in that filament yarn made of PET and having a thickness of 84 dtex was used as first yarn and second yarn.

In Comparative Example 3, filament yarn made of PET and having a thickness of 333 dtex was used as first yarn, and filament yarn made of rayon and having a thickness of 167 dtex was used as second yarn as in Example 1, but the difference was that no heat setting was performed.

Comparative Example 4 was different in that filament yarn made of PET and having a thickness of 167 dtex was used as first yarn, and spun yarn made of rayon and having a thickness of 295 dtex was used as second yarn. In addition, no heat setting was performed.

Evaluation Criteria

The evaluation results (crease resistance, texture, wear resistance, cold bending resistance, softness, chemical resistance, and comprehensive evaluation) shown in Table 1 and Table 2 are based on the following indexes.

For "Crease resistance," a measurement method of evaluating wrinkle resistance and wrinkle recoverability by visually determining the appearance of the fabric after wrinkling was used according to 2009 edition, JIS L 1059-2 (Wrinkle resistance test method for fiber products-Part 2: Evaluation of appearance after wrinkling (wrinkle method). More specifically, in a wrinkling device (wrinkle type wrinkle testing machine), test pieces of Examples 1 to 4 and Comparative Examples 1 to 4 were subjected to a compressive load with twisting and then determined in five grades in comparison with a 3D replica.

The "crease resistance" was evaluated based on evaluation criteria according to Section 9 of JIS L 1059-2 (Grade 5: the smoothest appearance to Grade 1: the most wrinkled appearance).

For "texture," the test pieces were used as a skin material for seats of automobiles, a feeling of use thereof was determined according to two grades according to a sensory test in comparison with a soft polyvinyl chloride leather (leather having a polyvinyl chloride composition in which a synthetic resin layer contained 100 parts by weight of polyvinyl chloride and 100 parts by weight of diethylhexyl phthalate as a plasticizer was mixed in).

In the evaluation results of "texture," evaluation was performed as follows: ○: the same texture as that of the soft polyvinyl chloride leather, and x: the texture was slightly inferior to the soft polyvinyl chloride leather.

In the test of "wear resistance," a Gakushin type friction testing machine defined in JIS L 0823 (friction testing machine for color fastness tests) was used, the friction test was performed at a load of 1 kg and according to JIS L 3102 No. 6 cotton canvas, and it was checked whether there was tearing after 30,000 reciprocations. The test results were evaluated according to two grades. Here, test pieces with a width of 10 mm and with 3 mm urethane foam attached thereto were used as the test pieces.

In the evaluation results of "wear resistance," evaluation was performed as follows: ○: there was no tearing of the synthetic resin layer, and x: there was tearing of the synthetic resin layer.

For the test of "cold bending resistance," a Demattia bending testing machine was used, a bending load was repeatedly applied to the test piece (70 mm×40 mm) with a certain stroke according to JIS K 6260, and the test was repeated 30,000 times at −30° C., and it was checked whether there was cracking. The test results were evaluated according to two grades.

In the evaluation results of "cold bending resistance," evaluation was performed as follows: ○: no cracking, and x: cracked.

"Softness" was evaluated by a sensory test in which the test pieces were touched with a hand and a feeling thereof was compared with that of the soft polyvinyl chloride leather, and determined according to two grades In the evaluation results of "softness," evaluation was performed as follows: ○: the same feeling, and x: hard feeling, not possible to replace that of the soft polyvinyl chloride leather For "chemical resistance," four pieces of filter paper were superimposed on the test pieces collected at an arbitrary size, 1.2 ml of oleic acid was added dropwise thereto, the test pieces were sealed with an aluminum foil, and left under an environment of 80° C. for 24 hours, the test pieces were then taken out, and wiped by tapping the surface, and lifting, tearing, and peeling off of the treated layer of the test pieces were visually observed, and the results were determined according to two grades.

In the evaluation results of "chemical resistance," evaluation was performed as follows: ○: good, and x: poor "Comprehensive evaluation" was comprehensively evaluation in three grades based on the above evaluation results of "crease resistance" "texture" "wear resistance" "cold bending resistance" "softness" and "chemical resistance."

In the evaluation results of "comprehensive evaluation," evaluation was performed as follows: ◎: the crease resistance was Grade 4 or higher and the results including the texture were generally favorable, ○: the crease resistance was Grade 4 or higher and the results including the texture were generally slightly favorable, and x: the crease resistance was less than Grade 4.

TABLE 1

| | | Example | | | |
|---|---|---|---|---|---|
| | | 1 | 2 | 3 | 4 |
| Base cloth layer | Material of yarn (first yarn/second yarn) | PET/rayon | PET/rayon | PET/PET | PET/PET |
| | Fineness (first yarn/second yarn: dtex) | 333/167 | 167/167 | 444/444 | 111/111 |
| | Thickness (mm) | 1.1 | 1.1 | 1.1 | 1.1 |
| | Heat setting (° C.) | 180 | 180 | 180 | 180 |
| Synthetic resin layer | Main material (mixing ratio) | TPU(85%) | TPU(85%) | TPU(85%) | TPU(85%) |
| | Hardness (A) | 85 | 85 | 85 | 85 |
| | Thickness (mm) | 0.35 | 0.35 | 0.35 | 0.35 |
| Adhesion layer | Material | PCU | PCU | PCU | PCU |
| | Thickness (mm) | 0.03 | 0.03 | 0.03 | 0.03 |
| Permanent distortion (%) | | 1.0 | 1.5 | 0.5 | 0.5 |
| Evaluation results | Crease resistance (grade) | 4 | 4 | 4 | 4 |
| | Texture | ◎ | ◎ | ○ | ○ |
| | Wear resistance | ○ | ○ | ○ | ○ |
| | Cold bending resistance | ○ | ○ | ○ | ○ |
| | Softness | ○ | ○ | ○ | ○ |
| | Chemical resistance | ○ | ○ | ○ | ○ |
| | Comprehensive evaluation | ◎ | ◎ | ○ | ○ |

TABLE 2

| | | Comparative Example | | | |
|---|---|---|---|---|---|
| | | 1 | 2 | 3 | 4 |
| Base cloth layer | Material of yarn (first yarn/second yarn) | PET/PET | PET/PET | PET/rayon | PET/rayon (spun yarn) |
| | Fineness (first yarn/second yarn: dtex) | 500/500 | 84/84 | 333/167 | 167/295 |
| | Thickness (mm) | 1.1 | 1.1 | 1.1 | 1.1 |
| | Heat setting (° C.) | 180 | 180 | None | None |
| Synthetic resin layer | Main material (mixing ratio) | TPU(85%) | TPU(85%) | TPU(85%) | TPU(85%) |
| | Hardness (A) | 85 | 85 | 85 | 85 |
| | Thickness (mm) | 0.35 | 0.35 | 0.35 | 0.35 |
| Adhesion layer | Material | PCU | PCU | PCU | PCU |
| | Thickness (mm) | 0.03 | 0.03 | 0.03 | 0.03 |
| Permanent distortion (%) | | 0.5 | 3.5 | 2.0 | 4.0 |
| Evaluation results | Crease resistance (grade) | 4 | 3 | 3.5 | 2.5 |
| | Texture | ○ | ○ | ○ | ○ |
| | Wear resistance | ○ | ○ | ○ | ○ |
| | Cold bending resistance | X | ○ | ○ | ○ |
| | Softness | ○ | ○ | ○ | ○ |
| | Chemical resistance | ○ | ○ | ○ | ○ |
| | Comprehensive evaluation | X | X | X | X |

Evaluation Results

Comparing Examples 1 to 4 and Comparative Examples 1 to 4, Examples 1 to 4 had favorable evaluation results in all of the crease resistance, texture, wear resistance, cold bending resistance, softness, chemical resistance, and comprehensive evaluation.

As can be clearly understood from the evaluation results, it was verified that Examples 1 to 4 were synthetic resin leathers having excellent durability against wrinkling and favorable texture without impairing flexibility of the synthetic resin layer during sitting in a seat or chair.

However, on the contrary, Comparative Examples 1 to 4 had poor crease resistance and cold bending resistance in the evaluation results.

More specifically, in Comparative Example 1, since the filament yarn was thicker than necessary, it felt hard, and the evaluation results of cold bending resistance were poor.

In Comparative Example 2, since the filament yarn was thinner than necessary, a feeling of tension of the knit fabric was insufficient and the evaluation results of crease resistance were poor.

In Comparative Example 3, although the filament yarn had an appropriate thickness, since a feeling of tension of the knit fabric was insufficient due to no heat setting, the evaluation results of crease resistance were poor.

In Comparative Example 4, since the filament yarn and the spun yarn were combined, a feeling of tension of the knit fabric was insufficient, and the evaluation results of crease resistance were poor. Here, the same test was performed on a combination of the filament yarn and the spun yarn, which was subjected to heat setting, but a feeling of tension of the knit fabric was insufficient and the evaluation results of crease resistance were poor.

REFERENCE SIGNS LIST

A Synthetic resin leather
1 Base cloth layer
1*f* Filament yarn
11 Knit fabric
11*a* Surface side
2 Synthetic resin layer
2*a* Back surface

What is claimed is:

1. A synthetic resin leather which is used as a skin material for a seat or chair, comprising:

a base cloth layer formed of a knit fabric; and a synthetic resin layer which has flexibility and is joined to one surface of the base cloth layer, wherein the knit fabric comprises a first yarn comprising a plurality of multifilament yarns and a second yarn comprising a singular multifilament yarn, wherein said first and second yarns are knitted together, wherein said multifilament yarn consists of a plurality of twisted long continuous fibers having a thickness ranging from 111 to 444 dtex;

wherein the relationship of the first and second yarns satisfy at least one of the below stipulations:

a. a material of the first yarn is the same as a material of the second yarn and the thickness of the twisted long continuous fibers of the first yarn are different from the thickness of the twisted long continuous fibers of the second yarn;

b. a material of the first yarn is different from a material of the second yarn and the thickness of the twisted long continuous fibers of the first yarn are the same as the thickness of the twisted long continuous fibers of the second yarn;

c. a material of the first yarn is the different from a material of the second yarn and the thickness of the twisted long continuous fibers of the first yarn are different from the thickness of the twisted long continuous fibers of the second yarn;

a dimensional stability of the knit fabric is maintained by heat setting; and a surface side of the knit fabric is adhered to a back surface side of the synthetic resin layer.

2. The synthetic resin leather which is used as a skin material for a seat or chair of claim 1;

wherein the material of the first yarn is different from a material of the second yarn and the thickness of the twisted long continuous fibers of the first yarn are the same as the thickness of the twisted long continuous fibers of the second yarn.

3. The synthetic resin leather according to claim 1, wherein the synthetic resin layer contains a polyurethane thermoplastic elastomer as a main component and the thickness of the synthetic resin layer is set to 0.25 times the thickness of the knit fabric or more.

4. The synthetic resin leather according to claim 2, wherein the synthetic resin layer contains a polyurethane thermoplastic elastomer as a main component and the thickness of the synthetic resin layer is set to 0.25 times the thickness of the knit fabric or more.

5. The synthetic resin leather according to claim 1, wherein a material of the first yarn is the different from a material of the second yarn and the thickness of the twisted long continuous fibers of the first yarn are different from the thickness of the twisted long continuous fibers of the second yarn.

6. The synthetic resin leather according to claim 1, wherein a material of the first yarn is the same as a material of the second yarn and the thickness of the twisted long continuous fibers of the first yarn are different from the thickness of the twisted long continuous fibers of the second yarn.

7. The synthetic resin leather according to claim 5, wherein the synthetic resin layer contains a polyurethane thermoplastic elastomer as a main component and the thickness of the synthetic resin layer is set to 0.25 times the thickness of the knit fabric or more.

8. The synthetic resin leather according to claim 6, wherein the synthetic resin layer contains a polyurethane thermoplastic elastomer as a main component and the thickness of the synthetic resin layer is set to 0.25 times the thickness of the knit fabric or more.

* * * * *